US008528359B2

(12) United States Patent
Lifson et al.

(10) Patent No.: US 8,528,359 B2
(45) Date of Patent: Sep. 10, 2013

(54) ECONOMIZED REFRIGERATION CYCLE WITH EXPANDER

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 960 days.

(21) Appl. No.: 12/446,890

(22) PCT Filed: Oct. 27, 2006

(86) PCT No.: PCT/US2006/042122

§ 371 (c)(1),
(2), (4) Date: Nov. 24, 2009

(87) PCT Pub. No.: WO2008/054380

PCT Pub. Date: May 8, 2008

(65) Prior Publication Data

US 2010/0077777 A1 Apr. 1, 2010

(51) Int. Cl.

| | |
|---|---|
| ***F25B 41/00*** | (2006.01) |
| ***F25B 9/00*** | (2006.01) |
| ***F25B 5/00*** | (2006.01) |
| ***F25B 49/00*** | (2006.01) |
| ***F25B 31/00*** | (2006.01) |

(52) U.S. Cl.
USPC ..... 62/513; 62/87; 62/113; 62/116; 62/196.2; 62/197; 62/505

(58) Field of Classification Search
USPC ..... 62/87, 113, 116, 196.1, 196.2, 197, 62/401, 402, 510, 512, 513, 527
See application file for complete search history.

(56) References Cited

U.S. PATENT DOCUMENTS

| | | | | |
|---|---|---|---|---|
| 4,918,942 | A * | 4/1990 | Jaster | 62/513 |
| 5,245,836 | A | 9/1993 | Lorentzen et al. | |
| 5,722,255 | A | 3/1998 | Brasz | |
| 6,058,727 | A | 5/2000 | Fraser, Jr. et al. | |
| 6,073,454 | A | 6/2000 | Spauschus et al. | |
| 6,571,576 | B1 | 6/2003 | Lifson et al. | |
| 6,644,045 | B1 | 11/2003 | Tang et al. | |
| 6,658,867 | B1 | 12/2003 | Taras et al. | |
| 6,698,234 | B2 | 3/2004 | Gopalnarayanan et al. | |

(Continued)

OTHER PUBLICATIONS

International Search Report and Written Opinion mailed Jul. 14, 2008 (9 pgs.).

*Primary Examiner* — Mohammad M Ali
*Assistant Examiner* — Daniel C Comings
(74) *Attorney, Agent, or Firm* — Cantor Colburn LLP

(57) ABSTRACT

A refrigerant vapor compression system includes a compression device, a heat rejecting heat exchanger, an economizer heat exchanger, an expander and an evaporator disposed in a refrigerant circuit. An evaporator bypass line is provided for passing a portion of the refrigerant flow from the main refrigerant circuit after having traversed a first pass of the economizer heat exchanger through the expander to partially expand it to an intermediate pressure and thence through a second pass of the economizer heat exchanger and into an intermediate pressure stage of the compression device. An economizer bypass line is also provided for passing a portion of the refrigerant from the main refrigerant circuit after having traversed the heat rejecting heat exchanger through a restrictor type expansion device and thence into the evaporator bypass line as liquid refrigerant or a mix of liquid and vapor refrigerant for injection into an intermediate pressure stage of the compression device. Both economizer and injection flows are mixed together prior to entering an intermediate compression point, when an economizer circuit is active. The invention allows for enhanced system performance and advanced discharge temperature control.

19 Claims, 2 Drawing Sheets

(56) References Cited

U.S. PATENT DOCUMENTS

| | | | | |
|---|---|---|---|---|
| 6,880,357 | B2 | 4/2005 | Nakatani et al. | |
| 6,923,016 | B2 | 8/2005 | Funakoshi et al. | |
| 2004/0118138 | A1* | 6/2004 | Nakatani et al. | 62/197 |
| 2005/0044885 | A1 | 3/2005 | Pearson | |
| 2006/0191288 | A1* | 8/2006 | Radermacher et al. | 62/513 |
| 2007/0074536 | A1* | 4/2007 | Bai | 62/513 |
| 2010/0083677 | A1* | 4/2010 | Lifson et al. | 62/115 |

* cited by examiner

ECONOMIZED REFRIGERATION CYCLE WITH EXPANDER

FIELD OF THE INVENTION

This invention relates generally to vapor compression systems and, more particularly, to refrigerant vapor compression systems equipped with an economizer cycle.

BACKGROUND OF THE INVENTION

Refrigerant vapor compression systems are well known in the art and commonly used for conditioning air (or other secondary media) to be supplied to a climate controlled comfort zone within a residence, office building, hospital, school, restaurant or other facility. Refrigerant vapor compression systems are also commonly used in transport refrigeration systems for refrigerating air supplied to a temperature controlled cargo space of a truck, trailer, container or the like for transporting perishable items and in commercial refrigeration systems for cooling air supplied to a temperature controlled space in a cold room, a beverage cooler, a diary case or a refrigerated merchandiser for displaying perishable foods item in a chilled or frozen state, as appropriate. Typically, these refrigerant vapor compression systems include a compressor, a condenser, an evaporator, and an expansion device. Commonly, the expansion device, typically a fixed orifice, a capillary tube, a thermostatic expansion valve (TXV) or an electronic expansion valve (EXV), is disposed in the refrigerant line upstream, with respect to refrigerant flow, of the evaporator and downstream of the condenser. These basic refrigerant system components are interconnected by refrigerant lines in a closed refrigerant circuit, arranged in accord with known refrigerant vapor compression cycles.

Traditionally, most of these refrigerant vapor compression systems operate at subcritical refrigerant pressures. Refrigerant vapor compression systems operating in the subcritical range are commonly charged with fluorocarbon refrigerants such as, but not limited to, hydrochlorofluorocarbons (HCFCs), such as R22, and more commonly hydrofluorocarbons (HFCs), such as R134a, R410A and R407C. Although HFC refrigerants are more environmentally friendly than the chlorine containing HCFC refrigerants that they replaced, "natural" refrigerants, such as carbon dioxide (also referred to as R744), are being turned to for use in air conditioning and transport refrigeration systems instead of HFC refrigerants.

Because carbon dioxide has a low critical point, most refrigerant vapor compression systems charged with carbon dioxide as the refrigerant are designed for operation in the transcritical pressure regime. In refrigerant vapor compression systems operating in a transcritical cycle, the refrigerant discharged from a compressor is a vapor having a temperature and pressure in excess of the refrigerant's critical point. As in conventional refrigerant vapor compression systems operating in a subcritical cycle, refrigerant vapor compression systems operating in a transcritical cycle, include a compression device, a heat rejecting heat exchanger functioning as a gas cooler rather than a condenser, an evaporator, and an expansion device arranged in accord with known refrigerant vapor compression cycles. Typically, the expansion device is a thermostatic expansion valve (TXV) or an electronic expansion valve (EXV) disposed in the refrigerant line upstream, with respect to refrigerant flow, of the evaporator and downstream of the gas cooler.

Refrigerant vapor compression systems utilizing a low critical point refrigerant, such as carbon dioxide, often employ a two-stage compression system, either a pair of compressors disposed in series flow arrangement with respect to refrigerant flow or a single compressor having at least two compression stages. To improve the refrigerant system performance and to control the temperature of the refrigerant vapor discharged from the final stage of the compression system over a wide range of operating conditions, commonly referred to as the discharge pressure or the high-side pressure, it is known to equip such systems with an economizer cycle incorporating a refrigerant-to-refrigerant economizer heat exchanger. The economizer heat exchanger is generally disposed in the refrigerant circuit intermediate the gas cooler and the evaporator to further cool the refrigerant in the main circuit exiting the gas cooler, and to return an expanded (to an intermediate pressure) portion of refrigerant having traversed the economizer heat exchanger in heat transfer interaction with the refrigerant in the main circuit as the supplementary cooling fluid to the compressor. Typically, the refrigerant vapor returned to the compressor is injected into an intermediate stage in the compression process, either through an injection port or ports opening into an intermediate pressure stage of the compression chamber (or chambers) of a single compressor or, in the case of a multiple compressor system, into a refrigerant line extending between the discharge outlet of the upstream compressor and the suction inlet of the downstream compressor. Additionally, liquid refrigerant may be taken from a location downstream of the heat rejecting heat exchanger and returned to the compressor, generally through a separate injection port or ports opening to an intermediate stage of the compression process. It is to be understood that the vapor injection in the economizer cycle and the liquid injection can potentially take place at different intermediate pressures in the compression process, especially in the case when vapor and liquid are injected through separate lines.

For example, U.S. Pat. No. 6,571,576 discloses a refrigerant vapor compression system operating in a subcritical cycle and equipped with an economizer heat exchanger wherein vapor refrigerant and liquid refrigerant are returned to an intermediate stage of the compression process through one or more economizer injection ports provided in the compressor. To provide the refrigerant vapor for injection into the compressor, liquid refrigerant is taken from the refrigerant circuit at a location downstream of the condenser, expanded to an intermediate pressure and lower temperature by means of an expansion valve to form a refrigerant liquid/vapor mixture which is thereafter passed through the economizer heat exchanger in heat exchange relationship with the main flow of refrigerant liquid. In traversing the economizer heat exchanger, this refrigerant liquid/vapor mixture extracts heat from the main flow of refrigerant liquid, further cooling this liquid, thereby evaporating any remaining liquid component in the two-phase mixture and typically further heating the vapor. The refrigerant vapor leaving the economizer heat exchanger is then injected into the compressor through the economizer injection ports at the intermediate (between suction and discharge) pressure. Additionally, liquid refrigerant is selectively taken from the refrigerant circuit at a location downstream of the condenser and mixed into the refrigerant vapor being passed from the economizer to the compressor and injected into an intermediate pressure stage of the compression process together with the refrigerant vapor through the same economizer injection ports.

U.S. Patent Application Publication No. US 2005/0044885 A1 discloses a transcritical cycle for a carbon dioxide refrigerant vapor compression system including a compressor, a gas cooler, a flash tank economizer, an evaporator, a first expansion valve upstream of the flash tank economizer and a second expansion valve downstream of the flash tank economizer. Refrigerant passing from the gas cooler to the evaporator is expanded to a lower pressure by the first expansion valve before entering the flash tank economizer wherein the refrigerant separates into a liquid component and a vapor component. The liquid refrigerant passes from the flash tank economizer through and is further expanded in the second expansion valve before traversing the evaporator. The vapor refrigerant returns to the compressor at some intermediate pressure.

U.S. Pat. No. 6,880,357 discloses a refrigerant cycle apparatus, using carbon dioxide as the refrigerant, that is equipped with an expander and optionally a sub-expander disposed in the refrigerant circuit between an outdoor heat exchanger and an indoor heat exchanger. High pressure refrigerant is taken from the refrigerant circuit and injected into an intermediate pressure stage of the expander. Power recovered during the expansion process in the expander and sub-expander may be used to drive the compressor or an electricity generator.

SUMMARY OF THE INVENTION

It is a general object of the invention to provide a refrigerant vapor compression system, which includes an expander and economizer cycle incorporating the injection of vapor and/or liquid refrigerant into at intermediate pressure stage in the compression process.

It is an object of an aspect of the invention to provide a refrigerant vapor compression system equipped with an expander and an economizer cycle and providing for the injection of vapor refrigerant and liquid refrigerant into at intermediate pressure stage in the compression process through a common line.

The refrigerant vapor compression system of the invention includes a compression device disposed in a refrigerant circuit for compressing a refrigerant vapor from a suction pressure to a discharge pressure, a heat rejecting heat exchanger disposed in the refrigerant circuit downstream with respect to refrigerant flow of the compression device, a heat accepting heat exchanger disposed in the refrigerant circuit downstream with respect to refrigerant flow of the heat rejecting heat exchanger and upstream with respect to refrigerant flow of the compression device, an economizer heat exchanger disposed in the refrigerant circuit downstream with respect to refrigerant flow of the heat rejecting heat exchanger and upstream with respect to refrigerant flow of the heat accepting heat exchanger, and an expander device disposed in the refrigerant circuit downstream with respect to refrigerant flow of the economizer heat exchanger and upstream with respect to refrigerant flow of the heat accepting heat exchanger. The economizer heat exchanger has a first pass and a second pass operatively associated in heat transfer relationship.

An evaporator bypass line is provided for passing a portion of the refrigerant from the main refrigerant circuit after having traversed the first pass of the economizer heat exchanger out of the expander device at an intermediate pressure during the expansion process and thence through the second pass of the economizer heat exchanger and into an intermediate pressure port of said compression device. An economizer bypass line is provided for passing a portion of the refrigerant from the main refrigerant circuit after having traversed the heat rejecting heat exchanger and partially expanded in the expander into the evaporator bypass line at a location upstream with respect to refrigerant flow of the second pass of the economizer heat exchanger. An expansion valve is disposed in the economizer bypass line for expanding the refrigerant passing therethrough to a lower pressure to provide liquid injection when desired. The economizer vapor injection and liquid injection can be engaged on demand. This invention would be the most beneficial for the transcritical cycle, where the benefits of using the expander as an expansion device are most pronounced.

In an embodiment of the invention, the expander device comprises a primary expander and a secondary expander. The primary expander is operatively connected in the refrigerant circuit upstream with respect to refrigerant flow of the evaporator to expand a major portion of the refrigerant flow having traversed the first pass of the economizer heat exchanger and circulating throughout the main refrigerant circuit. The secondary expander is operatively connected in the evaporator bypass line upstream with respect to refrigerant flow of the second pass of the economizer heat exchanger to expand a minor portion of the refrigerant flow having traversed the first pass of the economizer heat exchanger and circulating throughout the economizer loop. In this embodiment, the economizer loop refrigerant can be tapped off upstream of the economizer heat exchanger as well.

In another embodiment of the invention, the expander device comprises a single expander having a first stage of expansion for expanding the refrigerant vapor having traversed the first pass of the economizer heat exchanger to a pressure intermediate the discharge pressure and the suction pressure and a second stage of expansion for expanding the refrigerant vapor having traversed the first pass of the economizer heat exchanger to a pressure approximating the suction pressure. In this embodiment, the evaporator bypass line communicates with the expansion device to receive a flow of refrigerant at the intermediate pressure.

The compression device may consist of a first compressor having a discharge outlet connected by a refrigerant line in refrigerant flow communication to a suction inlet of a second compressor, with the evaporator bypass line opening into the refrigerant line at location between the discharge outlet of the first compressor and the suction inlet of the second compressor. The compression device may be a single compressor having a compression chamber (or chambers) with the evaporator bypass line communicating into the compression chamber (or chambers) at an intermediate stage in the compression process.

BRIEF DESCRIPTION OF THE DRAWINGS

For a further understanding of these and other objects and the advantageous of the invention, reference will be made to the following detailed description of the invention which is to be read in connection with the accompanying drawing, where.

DETAILED DESCRIPTION OF THE INVENTION

Figure 1:
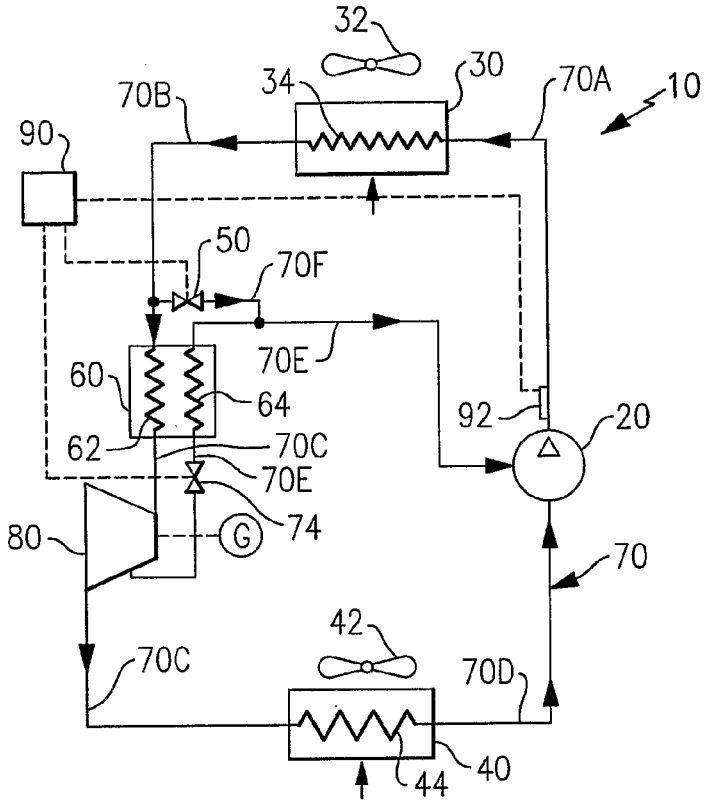
FIG. 1 is a schematic diagram illustrating a first exemplary embodiment of a refrigerant vapor compression system in accord with the invention.

The invention will be described further herein with respect to the embodiments of the refrigerant vapor compression system 10 depicted in FIGS. 1-2 preferably operating in a transcritical cycle and charged with carbon dioxide or other relatively low critical point refrigerant. As conventional systems, the refrigerant vapor compression system 10 includes a compression device 20, a refrigerant heat rejecting heat exchanger 30, also referred to as a gas cooler, a refrigerant heat absorbing heat exchanger 40, also referred to herein as an evaporator, and various refrigerant lines 70A, 70B, 70C and 70D connecting the aforementioned components in a basic refrigerant circuit 70. Although the refrigerant vapor compression system of the invention is particularly adapted to operate in a transcritical cycle with a low critical point refrigerant such as, for example, carbon dioxide, it is to be understood that the refrigerant vapor compression system described herein may also be operated in a subcritical cycle when charged with conventional refrigerants having a relatively high critical point temperature.

The compression device 20 operates to compress and circulate refrigerant through the refrigerant circuit as will be discussed in further detail hereinafter. In the embodiment depicted in FIG. 1, the compression device 20 is a single refrigerant compressor having at least a first compression stage and a second compression stage such as, for example, a scroll compressor or a screw compressor having staged compression pockets, or a reciprocating compressor having at least a first bank and a second bank of cylinders. In the embodiment depicted in FIG. 2, the compression device 20 is a pair of compressors 20A and 20B, such as, for example, a pair of scroll compressors, screw compressors, reciprocating compressors (or separate cylinders of a single reciprocating compressor) or rotary compressors connected in series, having a refrigerant line 22 connecting the discharge outlet port of the first compressor 20A, which constitutes a first compression stage, in refrigerant flow communication with the suction inlet port of the second compressor 20B, which constitutes a second compression stage.

In a refrigerant vapor compression system operating in a transcritical cycle, the compressor discharge pressure is high enough that the refrigerant vapor does not condense as it traverses the heat rejection heat exchanger 30. Consequently, with respect to systems operating in a transcritical cycle, the heat rejection heat exchanger 30 functions as, a refrigerant gas cooler, rather than a refrigerant vapor condenser. Supercritical refrigerant vapor discharged into refrigerant line 70A from the single compressor 20 in the FIG. 1 embodiment or from the second stage compressor 20B in the FIG. 2 embodiment passes in heat exchange relationship with and is cooled by a secondary cooling fluid, typically ambient outdoor air passed over the refrigerant conveying coils 34 by an air mover, such as one or more fans 32, operatively associated with the gas cooler 30. In a transcritical system, the refrigerant flow passes from the coils 34 of the gas cooler 30 into the refrigerant line 70B at a high pressure, lower temperature conditions.

A major portion of the refrigerant leaving the gas cooler 30 passes through refrigerant line 70B to the evaporator 40. In doing so, the refrigerant traverses the expansion device 80 and expands to a lower, typically subcritical pressure whereby the refrigerant enters the evaporator 40 as a lower temperature, lower pressure liquid refrigerant or more commonly liquid/vapor refrigerant mixture. In the refrigerant vapor compression system of the invention, the expansion device 80 is an expander, rather than a restrictor type expansion device such as: an expansion valve, capillary tube or fixed orifice. The evaporator 40 constitutes a refrigerant heat absorbing heat exchanger through which the liquid refrigerant passes in heat exchange relationship with a secondary fluid to be cooled and delivered to a conditioned environment whereby the refrigerant is heated thereby evaporating the liquid component and typically superheating the resultant vapor. The secondary fluid passed in heat exchange relationship with the refrigerant in the evaporator 40 may be air passed over the evaporator refrigerant coil 44 by an air mover, such as one or more fans 42 to condition the air by cooling the air and condensing moisture from the air. The conditioned air may be supplied to a climate controlled environment such as a comfort zone associated with an air conditioning system or a perishable product storage zone associated with a transport refrigeration unit or commercial refrigeration unit.

The refrigerant vapor compression system 10 of the invention further includes an economizer heat exchanger 60 disposed in the refrigerant circuit 70 between the gas cooler 30 and the evaporator 40. In the exemplary embodiment of the system 10 depicted in FIGS. 1 and 2, the economizer heat exchanger 60 is a refrigerant-to-refrigerant heat exchanger wherein a first flow of refrigerant passes through a first pass 62 of the economizer heat exchanger 60 in heat exchange relationship with a second flow of refrigerant passing through a second pass 64 of the economizer heat exchanger 60. The first flow of refrigerant comprises a major portion of the high pressure refrigerant vapor passing through refrigerant line 70B, while the second flow of refrigerant comprises a minor, economizer loop portion of the refrigerant passing through refrigerant line 70B.

As mentioned hereinbefore, the refrigerant vapor compression system 10 of the invention includes an expander device 80 for expanding at least a major portion of the refrigerant passing therethrough. The expander device 80 is disposed in refrigerant line 70C of the refrigerant circuit 70 downstream with respect to refrigerant flow of the economizer heat exchanger 60 and upstream with respect to refrigerant flow of the evaporator 40. In the embodiment of the refrigerant vapor compression system 10 depicted in FIG. 1, all of the refrigerant having traversed the heat exchange coil 62 of the economizer heat exchanger 60 enters a single expander device 80. A first portion of that refrigerant, which constitutes a major portion of the refrigerant, fully traverses the expander 80 and is thereby expanded to a lower subcritical pressure. This first portion of the refrigerant exits from the expander 80 into refrigerant line 70C and thereafter passes through the evaporator 40 as hereinbefore discussed.

In this embodiment, a second, economized portion of the refrigerant entering the expander device 80, which constitutes a minor portion of the refrigerant, does not fully traverse the expander 80, but rather is drawn off through a line 70E after having been only partially expanded in the expander 80 to pass through the second pass 64 of the economizer heat exchanger 60 in heat exchange relationship with the first portion of the refrigerant passing through the first pass 62 of the economizer heat exchanger 60. Having been partially expanded within the expander 80 to a lower pressure, intermediate the discharge pressure and the suction pressure, and lower temperature, the second portion of the refrigerant passing through the second pass 64 of the economizer heat exchanger 60 is cooler than the higher temperature, higher pressure refrigerant passing through the first pass 62 of the economizer heat exchanger 60. Therefore, the refrigerant flowing through the first pass 62 is cooled by rejecting heat to the second portion of the refrigerant flowing through the second pass 64, which is heated by the heat absorbed in cooling the refrigerant passing through the first pass 62 of the economizer heat exchanger 60.

Figure 2:
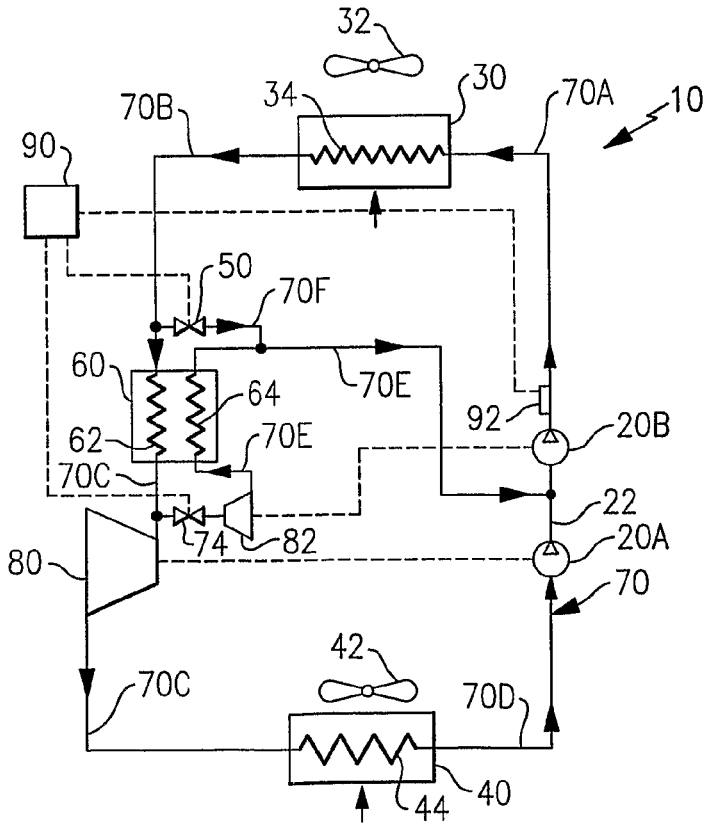
FIG. 2 is a schematic diagram illustrating a second exemplary embodiment of a refrigerant vapor compression system in accord with the invention.

In the embodiment of the refrigerant vapor compression system of the invention depicted in FIG. 2, the expansion device constitutes a primary expander 80 and a secondary expander 82. In this embodiment, the primary expander 80 may have only one stage of expansion, as the second stage of expansion is performed by the secondary expander 82. A portion of the refrigerant having traversed the first pass 62 of the economizer heat exchanger 60, which again constitutes a minor portion of the refrigerant, is diverted from the refrigerant line 70C into the refrigerant line 70E at a location upstream with respect to refrigerant flow of the primary expander 80 and downstream of the economizer heat exchanger 60. The remaining major portion of the refrigerant having traversed the first pass 62 of the economizer heat exchanger 60 continues on through refrigerant line 70C to pass through the primary expander 80, thereafter through the heat exchange coil 44 of the evaporator 40, and thence through refrigerant line 70D to return to the suction inlet port of the compressor 20A. The diverted minor portion of the refrigerant flowing through refrigerant line 70E passes through the secondary expander 82 disposed in refrigerant line 70E and is expanded therein to a lower intermediate pressure, lower intermediate temperature state prior to flowing through the second pass 64 of the economizer heat exchanger 60. Having been expanded within the secondary expander 82 to a lower pressure and lower temperature, the diverted minor portion of the refrigerant passing through the second pass 64 of the economizer heat exchanger 60 is cooler than the higher temperature, higher pressure refrigerant flowing through the first pass 62 of the economizer heat exchanger 60. Therefore, the refrigerant flowing through the first pass 62 of the economizer heat exchanger 60 is cooled by rejecting heat to the minor portion of the refrigerant flowing through the second pass 64 of the economizer heat exchanger 60, which is heated by the heat absorbed in cooling the refrigerant flowing through the first pass 62 of the economizer heat exchanger 60. It has to be understood that, in this embodiment, the minor, economizer portion of refrigerant can be tapped upstream of the economizer heat exchanger 60 as well.

In either embodiment of the invention, the second portion of the refrigerant having traversed the second pass 64 of the economizer heat exchanger 60 flows through the downstream leg of the refrigerant line 70E to return to the compression device 20 at an intermediate pressure state in the compression process. If, as depicted in FIG. 1, the compression device is a refrigerant compressor 20, for example a scroll compressor, a screw compressor or a multi-bank reciprocating compressor, the refrigerant from the second pass 64 of the economizer heat exchanger 60 enters the compressor through at least one injection port opening at an intermediate pressure state of compression within the compressor 20. If, as depicted in FIG. 2, the compression device 20 is a pair of compressors 20A and 20B connected in series relationship with respect to refrigerant flow, the refrigerant having traversed the second pass 64 of the economizer heat exchanger 60 is injected into the refrigerant line 22 connecting the discharge outlet port of the first stage compressor 20A in refrigerant flow communication with the suction inlet port of the second stage compressor 20B. Also, in both FIGS. 1 and 2 embodiments, a shutoff valve 74 may be provided to disengage the economizer loop from an active refrigerant circuit, if desired.

Additionally, in another aspect of the invention, a portion of the refrigerant vapor passing from the gas cooler 30 to the first pass 62 of the economizer heat exchanger 60 through the refrigerant line 70B is diverted through the refrigerant line 70F into the downstream leg of the refrigerant line 70E to provide additional cooling to the compression process. In passing through refrigerant line 70F, the diverted flow of refrigerant traverses an expansion valve 50 disposed in refrigerant line 70F and is expanded to a lower pressure and lower temperature to typically form a liquid refrigerant or a liquid/vapor refrigerant mixture. The resultant lower pressure and lower temperature liquid refrigerant or liquid/vapor refrigerant mixture then passes into the downstream leg of the refrigerant line 70E to return to the compression device 20. When the economizer loop is operational, the shutoff valve 74 is open and the refrigerant passing into refrigerant 70E from refrigerant line 70F will mix with the refrigerant vapor having traversed the second path 64 of the economizer heat exchanger 60 prior to being returned to the compression device 20 as herein before discussed.

The refrigerant vapor passing through the expansion valve 50, which may be an electrostatic expansion valve, EXV, or a thermostatic expansion valve, TXV, is expanded to a pressure lower than the compressor discharge pressure, but higher than the average refrigerant pressure existing at the intermediate compression stage at which the refrigerant passing through 70E returns to the compression device 20. Similarly, the portion of the refrigerant that is diverted to pass through the second pass 64 of the economizer heat exchanger 60 is tapped off the expander 80 at or expanded through the expander 82 to a pressure lower than the compressor discharge pressure, but higher than the average refrigerant pressure existing at the intermediate compression stage at which the refrigerant passing through 70E returns to the compression device 20.

Figure 3:
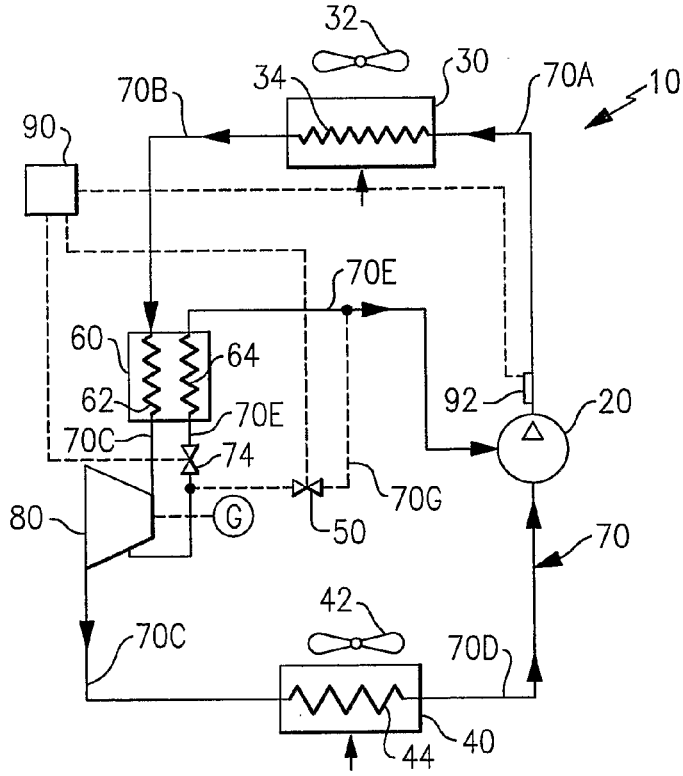
FIG. 3 is a schematic diagram illustrating an alternative arrangement of the exemplary embodiment of the refrigerant vapor compression system of the invention depicted in FIG. 1.
Figure 4:
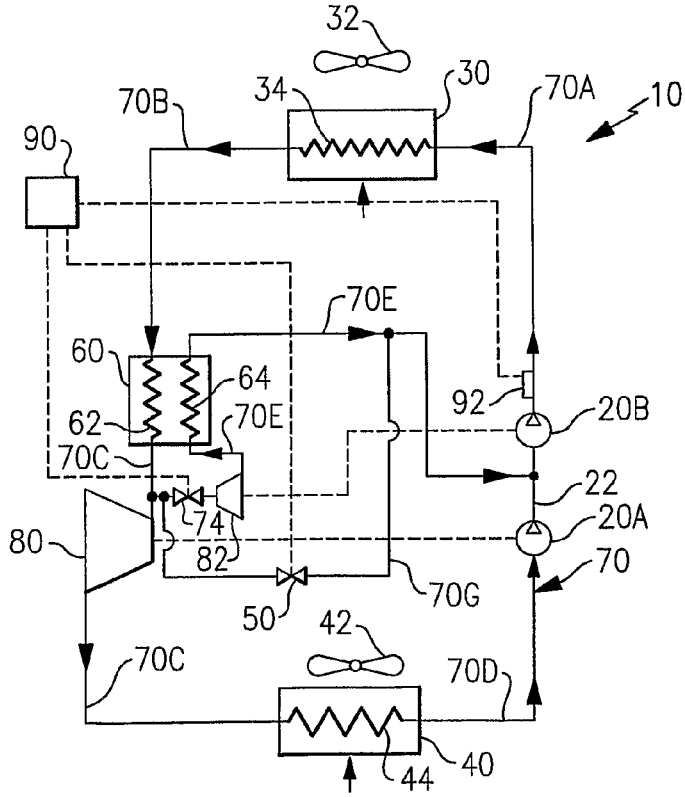
FIG. 4 is a schematic diagram illustrating an alternative arrangement of the exemplary embodiment of the refrigerant vapor compression system of the invention depicted in FIG. 2.

It should be pointed out that the expansion valve 50 may be positioned on the line 70E upstream of the second pass 64 of the economizer heat exchanger 60 and upstream of the shutoff valve 74 but downstream of the point within the refrigerant cycle where partial expansion of the minor economized portion of refrigerant flow has occurred. For example, in the exemplary embodiment of the refrigerant vapor compression system depicted in FIG. 3, the expansion valve 50 may be disposed in a refrigerant line 70G which provides a refrigerant flow path for a portion of the partially expanded refrigerant drawn off the primary expander 80 to pass from the refrigerant line 70E at a point upstream of the shutoff valve 74 to re-enter the refrigerant line 70E at a point downstream of the second pass 64 of the economizer heat exchanger 60. This portion of the refrigerant diverted from the refrigerant line 70E bypasses the economizer heat exchanger 60 and is further expanded as it traverses the expansion valve 50 to provide a liquid refrigerant or a liquid/vapor refrigerant mixture for injection into an intermediate pressure stage of the compression device 20 as hereinbefore discussed. Alternatively, as in the exemplary embodiment of the refrigerant vapor compression system depicted in FIG. 4, the expansion valve 50 may be disposed in a refrigerant line 70G which provides a refrigerant flow path for a portion of the unexpanded refrigerant passing from the refrigerant line 70C at a point upstream of the primary expander 80 into the refrigerant line 70E to pass from the refrigerant line 70E at a point upstream of both the shutoff valve 74 and the secondary expander 82 to re-enter the refrigerant line 70E at a point downstream of the second pass 64 of the economizer heat exchanger 60. This portion of the refrigerant diverted from refrigerant line 70E bypasses both the secondary expander 82 and the economizer heat exchanger 60 and is further expanded as it traverses the expansion valve 50 to provide a liquid refrigerant or a liquid/vapor refrigerant mixture for injection into an intermediate pressure between the first and second compression stages 20A and 20B as hereinbefore discussed.

The amount of liquid refrigerant flow passed through refrigerant line 70F and into the downstream leg of the refrigerant line 70E to mix with the refrigerant vapor passing therethrough from the second pass 64 of the economizer heat exchanger 60 when the shutoff valve 74 is open and be injected into an intermediate stage of the compression device 20 as a liquid/vapor refrigerant mixture, may be controlled by means of a controller 90 operatively associated with the expansion valve 50 disposed in refrigerant line 70F. The controller 90 is programmed in a conventional manner to control the degree of opening of the expansion valve 50 thereby controlling the flow rate of refrigerant passing through refrigerant line 70F from refrigerant line 70B. The controller 90 may also be programmed to monitor the compressor discharge temperature, that is the temperature of the refrigerant vapor discharging into refrigerant line 70A from the discharge outlet port of the second compression stage, and control the operation of the expansion valve 50 to provide sufficient liquid refrigerant flow into refrigerant line 70E to ensure that the compressor discharge temperature does not exceed a specified upper limit. The discharge temperature can be measured, for instance, by a temperature transducer 92. Also, the controller 90 can be operatively associated with the shutoff valve 74 to selectively open this valve when extra system capacity is required to satisfy thermal load demands in a conditioned space. The economized refrigerant flow may also assist in controlling the compressor discharge temperature such that it stays below the specified limit.

In an embodiment of the invention, the controller 90 constitutes the main system controller and receives operating data regarding various system operating parameters as in conventional practice, such as for purposes of illustration but not limitation, the refrigerant temperature and/or pressure at the compressor discharge, at the compressor suction inlet, at the evaporator outlet, and other locations, as desired, provided by appropriately disposed sensors (not shown). The controller 90 may also be programmed to control the operation of the expander 80 and the secondary expander 82 in response to selected system operating parameters. For example, the controller 90 may be programmed to control the speed of the expander 80 to adjust the refrigerant flow rate passing through refrigerant line 70C to the evaporator 40 as a means of controlling the evaporator outlet temperature. The controller 90 may also be programmed to control the speed of the secondary expander 82 to adjust the refrigerant flow rate returning through refrigerant line 70E to an injection port or ports in an intermediate stage of the compression device 20 as hereinbefore discussed. Alternatively, flow control valves (not shown) operatively associated with and controlled by the controller 90 may be provided in refrigerant line 70C upstream or downstream of the primary expander 80 to control the flow rate of refrigerant passing through the primary expander 80 and in refrigerant line 70E to control the flow rate of refrigerant passing through the second pass 64 of the economizer heat exchanger 60.

The particular type of expander used is not germane to the invention. The expanders 80 and 82 may be rotary vane expanders, screw expanders, scroll expanders or other conventional expanders. Using an expander as an expansion device in the refrigerant circuit rather than an expansion valve or fixed orifice, is advantageous as power generated by expansion of the refrigerant passing through the expander may be readily recovered rather than wasted. For example, as illustrated in FIG. 1, a generator, G, may be operatively associated with the expander 80 whereby the power recovered in the expander 80 is transferred to the generator, G, to generate electricity which could be used to at least partially power the compression device 20, the secondary fluid moving devices or for other purposes. As illustrated in FIG. 2, the expander 80 may be, for instance, operatively connected to assist in driving the first stage compressor 20A and the secondary expander 82 may be, for instance, operatively connected to the second stage compressor 20B, whereby the power recovered in the respective expansion process drives or assists in driving the respective compressors. Further, the expansion process in the expanders 80 and 82 is more thermodynamically efficient than in a restrictor-type expansion device (an expansion valve, an orifice or a capillary tube), since it follows isotropic, rather than isenthalpic, expansion line, where the refrigerant passing through an expander would have a higher thermodynamic potential at the evaporator entrance resulting in overall enhancement of the system efficiency and cooling capacity.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A refrigerant vapor compression system including a compression device disposed in a refrigerant circuit for compressing a refrigerant vapor from a suction pressure to a discharge pressure, a heat rejecting heat exchanger disposed in the refrigerant circuit downstream with respect to refrigerant flow of the compression device, and a heat accepting heat exchanger disposed in the refrigerant circuit downstream with respect to refrigerant flow of the heat rejecting heat exchanger and upstream with respect to refrigerant flow of the compression device, the refrigerant vapor compression system characterized by:

an economizer heat exchanger having a first pass and a second pass operatively associated in heat transfer relationship, the first pass disposed in the refrigerant circuit downstream with respect to refrigerant flow of the heat rejecting heat exchanger and upstream with respect to refrigerant flow of the heat accepting heat exchanger;

a primary expander disposed in the refrigerant circuit downstream with respect to refrigerant flow of the first pass of said economizer heat exchanger and upstream with respect to refrigerant flow of said heat accepting heat exchanger;

an evaporator bypass line providing a refrigerant flow path for passing a partially expanded portion of the refrigerant from the refrigerant circuit after having traversed the first pass of said economizer heat exchanger through the second pass of said economizer heat exchanger and into an intermediate pressure stage of said compression device;

an economizer bypass line for passing a portion of the refrigerant from the refrigerant circuit into said evaporator bypass line at a location downstream with respect to refrigerant flow of the second pass of said economizer heat exchanger; and a restrictor type expansion device disposed in said economizer bypass line for expanding the refrigerant passing therethrough to a lower pressure to provide a liquid component of refrigerant flow.

2. A refrigerant vapor compression system as recited in claim 1 further characterized in that said refrigerant circuit operates at least in part in a transcritical cycle.

3. A refrigerant vapor compression system as recited in claim 1 further characterized in that said refrigerant circuit operates at least in part in a subcritical cycle.

4. A refrigerant vapor compression system as recited in claim 1 further characterized in that said restrictor type expansion device is selected from the set of a fixed orifice, a capillary tube, a thermostatic expansion valve or an electronic expansion valve.

5. A refrigerant vapor compression system as recited in claim 1 further characterized in that the refrigerant circulating through the refrigerant circuit of said refrigerant vapor compression system is carbon dioxide.

6. A refrigerant vapor compression system as recited in claim 1 further characterized in that said economizer bypass line extends in refrigerant flow communication from a point in the refrigerant circuit upstream with respect to refrigerant flow of the first pass of the economizer heat exchanger and downstream with respect to refrigerant flow of the heat rejecting heat exchanger to a point in said evaporator bypass line downstream of the second pass of the economizer heat exchanger.

7. A refrigerant vapor compression system as recited in claim 1 further characterized in that said economizer bypass line extends in refrigerant flow communication from a point in the refrigerant circuit downstream with respect to refrigerant flow of the first pass of the economizer heat exchanger and upstream with respect to refrigerant flow of said primary expander to a point in said evaporator bypass line downstream of the second pass of the economizer heat exchanger.

8. A refrigerant vapor compression system as recited in claim 1 further characterized in that said evaporator bypass line extends in refrigerant flow communication from an intermediate expansion stage of said primary expander through the second pass of said economizer heat exchanger and into an intermediate compression stage of said compression device.

9. A refrigerant vapor compression system as recited in claim 8 further characterized in that said economizer bypass line extends in refrigerant flow communication from a point in the refrigerant circuit upstream with respect to refrigerant flow of the second pass of the economizer heat exchanger and downstream with respect to refrigerant flow of said primary expander to a point in said evaporator bypass line downstream of the second pass of the economizer heat exchanger.

10. A refrigerant vapor compression system as recited in claim 1 further characterized in that;

said evaporator bypass line extends in refrigerant flow communication from a point in the refrigerant circuit upstream with respect to refrigerant flow of said primary expander and downstream with respect to refrigerant flow of the first pass of said economizer heat exchanger through the second pass of said economizer heat exchanger and into an intermediate compression stage of said compression device; and a secondary expander disposed in said evaporator bypass line upstream with respect to refrigerant flow of the second pass of said economizer heat exchanger.

11. A refrigerant vapor compression system as recited in claim 10 further characterized in that said economizer bypass line extends in refrigerant flow communication from a point in the refrigerant circuit downstream with respect to refrigerant flow of the first pass of the economizer heat exchanger and upstream with respect to the refrigerant flow of both the primary expander and the secondary expander to a point in said evaporator bypass line downstream of the second pass of the economizer heat exchanger.

12. A refrigerant vapor compression system as recited in claim 10 further characterized in that said primary expander is operatively connected in the refrigerant circuit upstream with respect to refrigerant flow of said evaporator to expand a major portion of the refrigerant flow having traversed the first pass of the economizer heat exchanger, and said secondary expander is operatively connected in said evaporator bypass line upstream with respect to refrigerant flow of the second pass of said economizer heat exchanger to expand a minor portion of the refrigerant flow having traversed the first pass of the economizer heat exchanger.

13. A refrigerant vapor compression system as recited in claim 1 wherein said primary expander comprises a single expander having a first expansion process for expanding the refrigerant flow having traversed the first pass of the economizer heat exchanger to a pressure intermediate the discharge pressure and the suction pressure, and a second expansion process for expanding the refrigerant flow having traversed the first pass of the economizer heat exchanger to a pressure approximating the suction pressure, said evaporator bypass line communicating with said expander device to receive a flow of refrigerant at the intermediate pressure.

14. A refrigerant vapor compression system as recited in claim 1 wherein said compression device comprises a first compressor and a second compressor, the first compressor having a discharge outlet connected in refrigerant flow communication to a suction inlet of the second compressor by a refrigerant line, said evaporator bypass line communicating with said refrigerant line at location between the discharge outlet of the first compressor and the suction inlet of the second compressor.

15. A refrigerant vapor compression system as recited in claim 1 wherein the compression device comprises a single compressor having compression chambers, said evaporator bypass line communicating with the compression chambers at an intermediate compression stage.

16. A refrigerant vapor compression system as recited in claim 1 further characterized in that a refrigerant flow control device is disposed in said evaporator bypass line.

17. A method of controlling refrigerant discharge temperature from a compression device in a refrigerant vapor compression system including a compression device disposed in a refrigerant circuit for compressing a refrigerant vapor from a suction pressure to a discharge pressure, a heat rejecting heat exchanger disposed in the refrigerant circuit downstream with respect to refrigerant flow of the compression device, a heat accepting heat exchanger disposed in the refrigerant circuit downstream with respect to refrigerant flow of the heat rejecting heat exchanger and upstream with respect to refrigerant flow of the compression device, and an economizer heat exchanger having a first pass and a second pass disposed in heat exchange relationship, the first pass disposed in the refrigerant circuit upstream with respect to refrigerant flow of the heat accepting heat exchanger and downstream with respect to refrigerant flow of the heat rejecting heat exchanger, the method comprising the steps of:

passing a major portion of the refrigerant having traversed the first pass of said economizer heat exchanger through an expander to fully expand to a first pressure approximately equal to the suction pressure;

passing a minor portion of the refrigerant passing through the refrigerant circuit through an expander to partially expand to a second pressure greater than the first pressure and intermediate the suction pressure and the discharge pressure; and selectively passing the minor portion of partially expanded refrigerant through the second pass of the economizer heat exchanger and thence into an intermediate pressure stage of said compression device.

18. A method as recited in claim 17 further comprising the step of controlling the amount of refrigerant in the minor portion of partially expanded refrigerant flow passed through the second pass of the economizer heat exchanger and thence into an intermediate pressure stage of said compression device.

19. A method as recited in claim 17 further comprising the step of selectively injecting refrigerant liquid from the refrigerant circuit into an intermediate pressure stage of said compression device.

* * * * *